US011450158B2

(12) United States Patent
Chong et al.

(10) Patent No.: US 11,450,158 B2
(45) Date of Patent: Sep. 20, 2022

(54) TOUCH ISOLATED ELECTRONIC LOCK

(71) Applicant: Spectrum Brands, Inc., Middleton, WI (US)

(72) Inventors: Gerald Chong, Mission Viejo, CA (US); Thomas P. Morse, Wyomissing, PA (US); Alan Uyeda, Irvine, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 16/239,773

(22) Filed: Jan. 4, 2019

(65) Prior Publication Data

US 2019/0213813 A1 Jul. 11, 2019

Related U.S. Application Data

(60) Provisional application No. 62/613,944, filed on Jan. 5, 2018.

(51) Int. Cl.
*G07C 9/00* (2020.01)
*E05B 47/00* (2006.01)
(Continued)

(52) U.S. Cl.
CPC ..... *G07C 9/00182* (2013.01); *E05B 17/002* (2013.01); *E05B 47/0001* (2013.01);
(Continued)

(58) Field of Classification Search
CPC ..... G07C 9/00309; G07C 2009/00928; G07C 9/00182; G07C 9/28; G07C 2009/00769;
(Continued)

(56) References Cited

U.S. PATENT DOCUMENTS 3,733,861 A 5/1973 Lester
3,794,848 A 2/1974 Peters et al.
(Continued)

FOREIGN PATENT DOCUMENTS

CN 1317066 A 10/2001
CN 1922353 A 2/2004
(Continued)

OTHER PUBLICATIONS

Website Material on Touch Sensor (Oct. 20, 2010); entitled "AC Type 8 Disabled Persons Toilety System"; http://www.autodoorsprings.co.uk/diabled_persons_toilet_system.html.

*Primary Examiner* — Stephen R Burgdorf
(74) *Attorney, Agent, or Firm* — Merchant & Gould, P.C.

(57) ABSTRACT

An electronic lock includes a latch assembly that has a latch housing and a bolt. The bolt is movable between an extended position and a retracted position. The electronic lock includes a controller connected to a circuit board. The controller is configured to electronically control movement of the bolt between the extended position and the retracted position. The electronic lock includes an exposed conductive touch member. The conductive touch member is in electrical communication with the controller. The electronic lock includes an insulating arrangement positioned between the conductive touch member and the circuit board. The electronic lock includes a housing at least partially surrounding the conductive touch member. The housing is electrically isolated from the conductive touch member by at least a portion of the insulating arrangement.

19 Claims, 14 Drawing Sheets

(51) Int. Cl.
*E05B 17/00* (2006.01)
*E05B 47/02* (2006.01)
*E05B 27/00* (2006.01)

(52) U.S. Cl.
CPC ..... *E05B 47/026* (2013.01); *E05B 27/00* (2013.01); *E05B 2047/005* (2013.01); *E05B 2047/0014* (2013.01); *E05B 2047/0071* (2013.01); *E05B 2047/0084* (2013.01)

(58) Field of Classification Search
CPC ..... G07C 2009/00793; G07C 5/008; G07C 9/00896; G07C 2209/63; G07C 9/00571; A45C 11/00; A45C 13/008; A61B 12/07207; E05B 17/002; E05B 17/22; E05B 27/00; E05B 47/00; E05B 47/0001; E05B 47/002; E05B 47/02; E05B 47/0026; E05B 2047/0014; E05B 2047/005; E05B 2047/0071; E05B 2047/0084; G06F 1/1613; G06F 1/1633; G06F 1/1626; H04B 1/3888; H05K 9/0007
USPC ..... 340/5.64
See application file for complete search history.

(56) References Cited

U.S. PATENT DOCUMENTS

RE29,341 E 8/1977 Peters et al.
4,439,808 A 3/1984 Gillham
4,485,381 A 11/1984 Lewiner et al.
4,573,720 A 3/1986 Nicolai
4,672,229 A * 6/1987 Skarman ..... H02M 5/2573 307/115
4,685,316 A 8/1987 Hicks et al.
4,763,937 A 8/1988 Sittnick, Jr. et al.
5,000,497 A 3/1991 Geringer et al.
5,029,912 A 7/1991 Gotanda
5,088,779 A 2/1992 Weiss
5,247,282 A 9/1993 Marshall
5,261,260 A 11/1993 Lin
5,291,068 A * 3/1994 Rammel ..... H03K 17/9505 200/512
5,386,713 A 2/1995 Wilson
5,392,025 A 2/1995 Figh et al.
5,429,399 A 7/1995 Geringer et al.
5,474,342 A 12/1995 Smith et al.
5,712,626 A 1/1998 Anderou et al.
5,715,712 A 2/1998 West
5,729,198 A 3/1998 Gorman
5,799,518 A 9/1998 Du
5,920,268 A 7/1999 Bucci et al.
5,926,106 A 7/1999 Beran et al.
5,933,086 A 8/1999 Tischendorf et al.
5,936,544 A 8/1999 Gonzales et al.
5,943,888 A 8/1999 Lawson
5,987,818 A 11/1999 Dabideen
5,996,383 A 12/1999 Adelmeyer et al.
6,005,306 A 12/1999 Pickard
6,034,617 A 3/2000 Luebke et al.
6,112,563 A 9/2000 Ramos
6,128,933 A 10/2000 MIrshafiee et al.
6,209,369 B1 4/2001 Freck
6,271,751 B1 8/2001 Hunt et al.
6,297,725 B1 10/2001 Tischendorf et al.
6,323,782 B1 11/2001 Stephens et al.
6,406,074 B1 6/2002 Mahaney
6,725,127 B2 4/2004 Stevens
6,886,380 B2 5/2005 Kato et al.
6,957,767 B2 10/2005 Aupperle et al.
6,967,562 B2 11/2005 Menard et al.
6,976,919 B2 12/2005 Cole
7,023,319 B2 4/2006 Hwang
RE39,144 E 6/2006 Pickard
7,113,070 B2 9/2006 Deng et al.
7,165,428 B2 1/2007 Isaacs et al.
7,239,238 B2 7/2007 Tester et al.
7,248,836 B2 7/2007 Taylor
7,249,705 B2 7/2007 Dudley
7,289,764 B2 10/2007 Gonzales et al.
7,296,448 B1 11/2007 Shaw
7,304,572 B2 12/2007 Sheynman et al.
7,334,443 B2 2/2008 Meekma et al.
7,346,331 B2 3/2008 Taylor et al.
7,346,439 B2 3/2008 Bodin
7,378,939 B2 5/2008 Sengupta et al.
7,389,661 B2 6/2008 Viviano et al.
7,391,319 B1 6/2008 Walker
7,446,644 B2 11/2008 Schaffzin et al.
7,471,191 B2 12/2008 Le Gars
7,481,471 B2 1/2009 Andersen et al.
7,624,280 B2 11/2009 Oskari
7,696,878 B2 4/2010 Cable et al.
7,701,331 B2 4/2010 Tran
7,747,286 B2 6/2010 Conforti
7,828,345 B2 11/2010 Terry et al.
7,828,346 B2 11/2010 Terry et al.
7,845,201 B2 12/2010 Meyerle et al.
7,849,721 B2 12/2010 Bass et al.
7,908,896 B1 3/2011 Olson et al.
7,952,477 B2 5/2011 Fogg
7,967,459 B2 6/2011 Schluep et al.
7,973,657 B2 7/2011 Ayed
7,994,925 B2 8/2011 Lahiri
7,999,656 B2 8/2011 Fisher
8,002,180 B2 8/2011 Harper et al.
8,011,217 B2 9/2011 Marschalek et al.
8,026,792 B2 9/2011 Powers et al.
8,026,816 B2 9/2011 Chao Cheng
8,035,478 B2 10/2011 Lee
8,035,479 B2 10/2011 Tran
8,069,693 B2 12/2011 Powers et al.
8,074,481 B2 12/2011 Bass et al.
8,079,240 B2 12/2011 Brown et al.
8,093,986 B2 1/2012 Harvey
8,106,752 B2 1/2012 Golden
8,115,609 B2 2/2012 Ketari
8,240,085 B2 8/2012 Hill
8,264,329 B2 9/2012 Roberts et al.
8,272,241 B2 9/2012 Brown et al.
8,292,337 B2 10/2012 Chang
8,347,659 B2 1/2013 Powers et al.
8,358,197 B2 1/2013 Tran
8,358,198 B2 1/2013 Harper et al.
8,360,307 B2 1/2013 Rudduck et al.
8,555,684 B1 10/2013 Chen
8,643,469 B2 2/2014 Häberli
8,683,833 B2 4/2014 Marschalek et al.
8,692,650 B2 4/2014 Pöllabauer
8,701,353 B2 4/2014 Patel et al.
8,925,982 B2 1/2015 Bliding et al.
9,024,759 B2 * 5/2015 Uyeda ..... E05B 47/06 340/542
9,085,919 B2 * 7/2015 Bacon ..... E05B 13/10
9,151,096 B2 10/2015 Hunt et al.
9,322,194 B2 4/2016 Cheng et al.
9,336,637 B2 5/2016 Neil et al.
9,340,999 B2 5/2016 Romero
9,359,794 B2 6/2016 Cheng
9,382,739 B1 7/2016 Johnson et al.
9,424,700 B2 8/2016 Lovett et al.
9,447,604 B2 9/2016 Witte et al.
9,528,294 B2 12/2016 Johnson et al.
9,530,262 B2 12/2016 Johnson
9,546,504 B2 1/2017 Overgaard
9,574,372 B2 2/2017 Johnson et al.
9,670,696 B2 * 6/2017 Chong ..... G07C 9/00944
9,725,927 B1 8/2017 Cheng
9,758,991 B2 * 9/2017 Lin ..... E05B 17/002
9,933,469 B1 * 4/2018 Ridenour ..... A61B 5/053
9,955,780 B2 * 5/2018 Koch ..... A47B 9/00
10,017,963 B2 7/2018 Johnson et al.
10,024,081 B2 7/2018 Li et al.

(56) References Cited

U.S. PATENT DOCUMENTS 10,037,636 B2 7/2018 Ho et al.
10,208,508 B2 2/2019 Tien
2001/0045803 A1 11/2001 Cencur
2002/0109582 A1 8/2002 Mooney et al.
2002/0140542 A1 10/2002 Prokoski et al.
2003/0084691 A1 5/2003 Kato et al.
2003/0114206 A1 6/2003 Timothy et al.
2003/0230124 A1 12/2003 Johnson et al.
2004/0011094 A1 1/2004 Hsieh
2004/0035160 A1 2/2004 Mecma et al.
2004/0157842 A1 8/2004 Arnold et al.
2004/0183652 A1 9/2004 Deng et al.
2004/0257209 A1 12/2004 Yang
2005/0035848 A1 2/2005 Syed et al.
2005/0046545 A1 3/2005 Skekloff et al.
2005/0116480 A1 6/2005 Deng et al.
2005/0204787 A1 9/2005 Ernst et al.
2005/0237166 A1 10/2005 Chen
2005/0279823 A1 12/2005 Mitchell
2006/0000247 A1 1/2006 Moon et al.
2006/0022794 A1 2/2006 Determan et al.
2006/0092378 A1 5/2006 Marsden et al.
2006/0103545 A1 5/2006 Tsou
2006/0113368 A1 6/2006 Dudley
2006/0114099 A1 6/2006 Deng et al.
2006/0131159 A1* 6/2006 Kaps ..... H03K 17/962 200/600
2006/0226948 A1* 10/2006 Wright ..... E05B 47/0673 340/5.25
2006/0266089 A1 11/2006 Dimig
2006/0273879 A1 12/2006 Pudelko et al.
2006/0283219 A1 12/2006 Bendz et al.
2007/0083921 A1 4/2007 Parris et al.
2007/0090921 A1 4/2007 Fisher
2007/0103451 A1* 5/2007 Heimann ..... D06F 34/28 345/173
2007/0115094 A1 5/2007 Gillert et al.
2007/0126562 A1 6/2007 Ku
2007/0163863 A1 7/2007 Mitchell et al.
2007/0176739 A1 8/2007 Raheman
2007/0180869 A1 8/2007 Geyer
2007/0204663 A1 9/2007 Lee
2007/0214848 A1 9/2007 Meyerle et al.
2007/0226142 A1 9/2007 Hanna et al.
2007/0227913 A1* 10/2007 Shoenfeld ..... E05B 47/0012 206/1.5
2007/0257773 A1 11/2007 Hill et al.
2007/0290793 A1 12/2007 Tran
2008/0061927 A1 3/2008 Manton
2008/0129059 A1 6/2008 Chang
2008/0134732 A1 6/2008 Petersen
2008/0186171 A1 8/2008 Gates
2008/0196457 A1 8/2008 Goldman
2008/0250716 A1 10/2008 Ranaudo et al.
2008/0252414 A1 10/2008 Crigger et al.
2008/0278335 A1 11/2008 Welte
2008/0289383 A1 11/2008 Levine
2008/0303630 A1 12/2008 Martinez
2008/0314097 A1 12/2008 Rohlfing et al.
2009/0107829 A1* 4/2009 Heimann ..... H03K 17/962 200/600
2009/0108596 A1 4/2009 Terry et al.
2009/0135015 A1 5/2009 Dobson et al.
2009/0151410 A1 6/2009 Hapke
2009/0173119 A1 7/2009 Hunt et al.
2009/0183541 A1 7/2009 Sadighi et al.
2009/0201127 A1 8/2009 Stobbe et al.
2009/0211319 A1 8/2009 McCormack
2009/0223265 A1 9/2009 Chang
2009/0231132 A1 9/2009 Shoenfeld
2009/0249846 A1 10/2009 Gokcebay
2009/0256677 A1 10/2009 Hein et al.
2009/0273440 A1 11/2009 Marsehalek et al.
2009/0280862 A1 11/2009 Loughlin et al.
2009/0293561 A1 12/2009 Jakobsen et al.
2009/0308116 A1 12/2009 Lambrou
2009/0320538 A1 12/2009 Pellaton
2010/0031713 A1* 2/2010 Brown ..... E05B 47/00 70/91
2010/0031714 A1 2/2010 Brown et al.
2010/0066507 A1 3/2010 Myllymäki
2010/0102927 A1 4/2010 Mönig
2010/0126071 A1 5/2010 Hill
2010/0201536 A1 8/2010 Robertson et al.
2010/0218569 A1 9/2010 Hunt et al.
2010/0225123 A1 9/2010 Chiang et al.
2010/0259387 A1 10/2010 Jiang
2010/0300163 A1 12/2010 Loughlin et al.
2010/0307206 A1 12/2010 Taylor et al.
2010/0326146 A1 12/2010 Powers et al.
2010/0328089 A1 12/2010 Eichenstein et al.
2011/0005282 A1 1/2011 Powers et al.
2011/0056253 A1 3/2011 Greiner et al.
2011/0067308 A1 3/2011 Hunt et al.
2011/0084856 A1 4/2011 Kleindiendst et al.
2011/0128143 A1 6/2011 Daniel
2011/0148631 A1 6/2011 Lanham et al.
2011/0185779 A1 8/2011 Crass et al.
2011/0203331 A1 8/2011 Picard et al.
2011/0204656 A1 8/2011 Lai
2011/0252843 A1 10/2011 Sumcad et al.
2011/0255250 A1* 10/2011 Dinh ..... G03B 15/03 361/749
2011/0259059 A1* 10/2011 Wu ..... E05B 47/0012 70/91
2011/0265527 A1 11/2011 Saari
2011/0265528 A1 11/2011 Saari
2011/0283755 A1 11/2011 Chen
2011/0291798 A1 12/2011 Schibuk
2012/0011907 A1 1/2012 Sprenger et al.
2012/0031153 A1 2/2012 Conti
2012/0032775 A1 2/2012 Kikuchi
2012/0086569 A1 4/2012 Golden
2012/0096909 A1 4/2012 Hart et al.
2012/0119877 A1 5/2012 Ng et al.
2012/0154115 A1 6/2012 Herrala
2012/0169453 A1 7/2012 Bryla et al.
2012/0186308 A1 7/2012 Garthe
2012/0222103 A1 8/2012 Bliding et al.
2012/0227450 A1 9/2012 Ufkes
2012/0229251 A1 9/2012 Ufkes
2012/0234058 A1 9/2012 Neil et al.
2012/0280789 A1 11/2012 Gerhardt et al.
2012/0293655 A1 11/2012 Loughlin et al.
2012/0306617 A1 12/2012 Tung
2012/0309364 A1 12/2012 Quady
2012/0324968 A1 12/2012 Goren et al.
2013/0008213 A1 1/2013 Brown et al.
2013/0014549 A1 1/2013 Cavanaugh
2013/0027180 A1 1/2013 Lakamraju et al.
2013/0086956 A1 4/2013 Nave
2014/0260448 A1 9/2014 Beck et al.
2014/0300116 A1 10/2014 Hellwig et al.
2015/0159411 A1 6/2015 Son et al.
2015/0269799 A1 9/2015 Martinez et al.
2016/0032621 A1 2/2016 Johnson et al.
2016/0047145 A1 2/2016 Johnson et al.
2016/0115713 A1* 4/2016 Lin ..... E05B 17/002 70/266
2016/0307380 A1 10/2016 Ho et al.
2016/0319569 A1 11/2016 Johnson et al.
2016/0326773 A1* 11/2016 Tobias ..... E05B 45/06
2017/0018956 A1* 1/2017 Geiszler ..... H02J 50/10
2017/0114577 A1 4/2017 Beshke, Sr. et al.
2017/0116801 A1* 4/2017 Hallett ..... E05B 9/08
2017/0204636 A1 7/2017 Sack
2017/0284131 A1* 10/2017 Lin ..... G07C 9/00944
2017/0301166 A1 10/2017 Earles et al.
2017/0306648 A1 10/2017 Ramsauer et al.
2017/0352216 A1 12/2017 Donovan
2017/0358160 A1 12/2017 Gardiner et al.
2018/0073274 A1 3/2018 Johnson et al.
2018/0108192 A1 4/2018 Ho et al.

(56) References Cited

U.S. PATENT DOCUMENTS

| | | | | |
|---|---|---|---|---|
| 2018/0135336 | A1 | 5/2018 | Johnson et al. | |
| 2018/0135337 | A1 | 5/2018 | Johnson et al. | |
| 2018/0171660 | A1 | 6/2018 | Snider | |
| 2018/0179786 | A1 | 6/2018 | Johnson | |
| 2018/0266142 | A1* | 9/2018 | Wong | F16J 15/106 |

FOREIGN PATENT DOCUMENTS

| | | | |
|---|---|---|---|
| CN | 1947158 | A | 4/2007 |
| CN | 101046129 | A | 10/2007 |
| CN | 102747893 | A | 10/2012 |
| EP | 0730073 | A2 | 9/1996 |
| EP | 1719753 | A2 | 10/2006 |
| GB | 2227052 | A | 7/1990 |
| WO | 9309319 | A1 | 5/1993 |
| WO | 2011109005 | A1 | 9/2011 |

* cited by examiner

TOUCH ISOLATED ELECTRONIC LOCK

CROSS-REFERENCE TO RELATED APPLICATIONS

This application claims the benefit of U.S. Provisional Application No. 62/613,944, filed Jan. 5, 2018, the disclosure of which is hereby incorporated herein by reference.

BACKGROUND

Electronic locks have gained increasing acceptance and widespread use in residential and commercial markets. These locksets control ingress through doors in a building by requiring certain electronic credentials. For example, these locksets typically include a control circuit that determines whether to unlock the lockset based on credentials provided by the user. In some cases, for example, the credentials and/or commands may be provided wirelessly to the lockset, as disclosed in U.S. Pat. No. 9,336,637 for a "Wireless Access Control System and Related Methods," which is hereby incorporated by reference in its entirety. In some examples, the electronic lock can sense credentials held by a nearby, authorized user and require the user to physically touch the lock to activate the lock, as disclosed in U.S. Pat. No. 9,024,759 for a "Wireless Lockset with Integrated Antenna, Touch Activation, and Light Communication Method," which is hereby incorporated by reference in its entirety.

The physical appearance of the lockset is important to some users. Some users prefer all the hardware in their home to match, or at least be from the same style line. Typically, with traditional non-electronic locks, this was accomplished by changing out a trim or facade of a lockset. However, when using a touch-activated lockset, maintaining a proper seal around internal electronics and ensuring reliable touch activation makes a lockset housing swap difficult.

Therefore, improvements in electronic lock design are desired.

SUMMARY

The present disclosure relates generally to door locks. In one possible configuration, and by non-limiting example, an electronic lock with an isolated touch member and an outer housing is disclosed.

In one example of the present disclosure, an electronic lock is disclosed. The electronic lock includes a latch assembly that has a latch housing and a bolt. The bolt is movable between an extended position and a retracted position. The electronic lock includes a controller connected to a circuit board. The circuit board is positioned within an interior cavity. The cavity is at least partially defined by the latch housing. The controller is configured to electronically control movement of the bolt between the extended position and the retracted position. The electronic lock includes an exposed conductive touch member. The conductive touch member is in electrical communication with the controller. The electronic lock includes an insulating arrangement positioned between the conductive touch member and the circuit board. The electronic lock includes a housing at least partially surrounding the conductive touch member. The housing is electrically isolated from the conductive touch member by at least a portion of the insulating arrangement.

In another example of the present disclosure, an electronic lock is disclosed. The electronic lock includes a latch assembly that has a latch housing and a bolt. The bolt is movable between an extended position and a retracted position. The electronic lock includes a controller mounted to a circuit board. The circuit board is positioned within an interior cavity. The cavity is at least partially defined by the latch housing. The controller is configured to electronically control movement of the bolt between the extended position and the retracted position. The electronic lock includes an exposed conductive touch member. The conductive touch member is in electrical communication with the controller. The electronic lock includes an insulating arrangement positioned between the conductive touch member and the circuit board. The insulating arrangement includes a translucent portion configured to transmit light and at least one seal. The translucent portion at least partially defines the interior cavity. The translucent portion is at least partially exposed adjacent the touch member. The at least one seal is positioned between at least one of the translucent portion and the latch housing and the translucent portion and touch member to seal the interior cavity. The electronic lock includes a housing at least partially surrounding the conductive touch member. The housing is electrically isolated from the conductive touch member by at least a portion of the insulating arrangement.

In another example of the present disclosure, an electronic lock is disclosed. The electronic lock includes a latch assembly that has a latch housing and a bolt. The bolt is movable between an extended position and a retracted position. The electronic lock includes a controller mounted to a circuit board. The circuit board is positioned within an interior cavity. The cavity is at least partially defined by the latch housing. The controller is configured to electronically control movement of the bolt between the extended position and the retracted position. The electronic lock includes an exposed conductive touch member. The conductive touch member is in electrical communication with the controller via a conductor. The electronic lock includes an insulating arrangement positioned between the conductive touch member and the circuit board. The insulating arrangement includes a body at least partially defining the interior cavity. The body defines an aperture that is configured to receive the conductor. A first seal of the insulating arrangement surrounds the aperture. The electronic lock includes a housing at least partially surrounding the conductive touch member. The housing is electrically isolated from the conductive touch member by at least a portion of the insulating arrangement.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
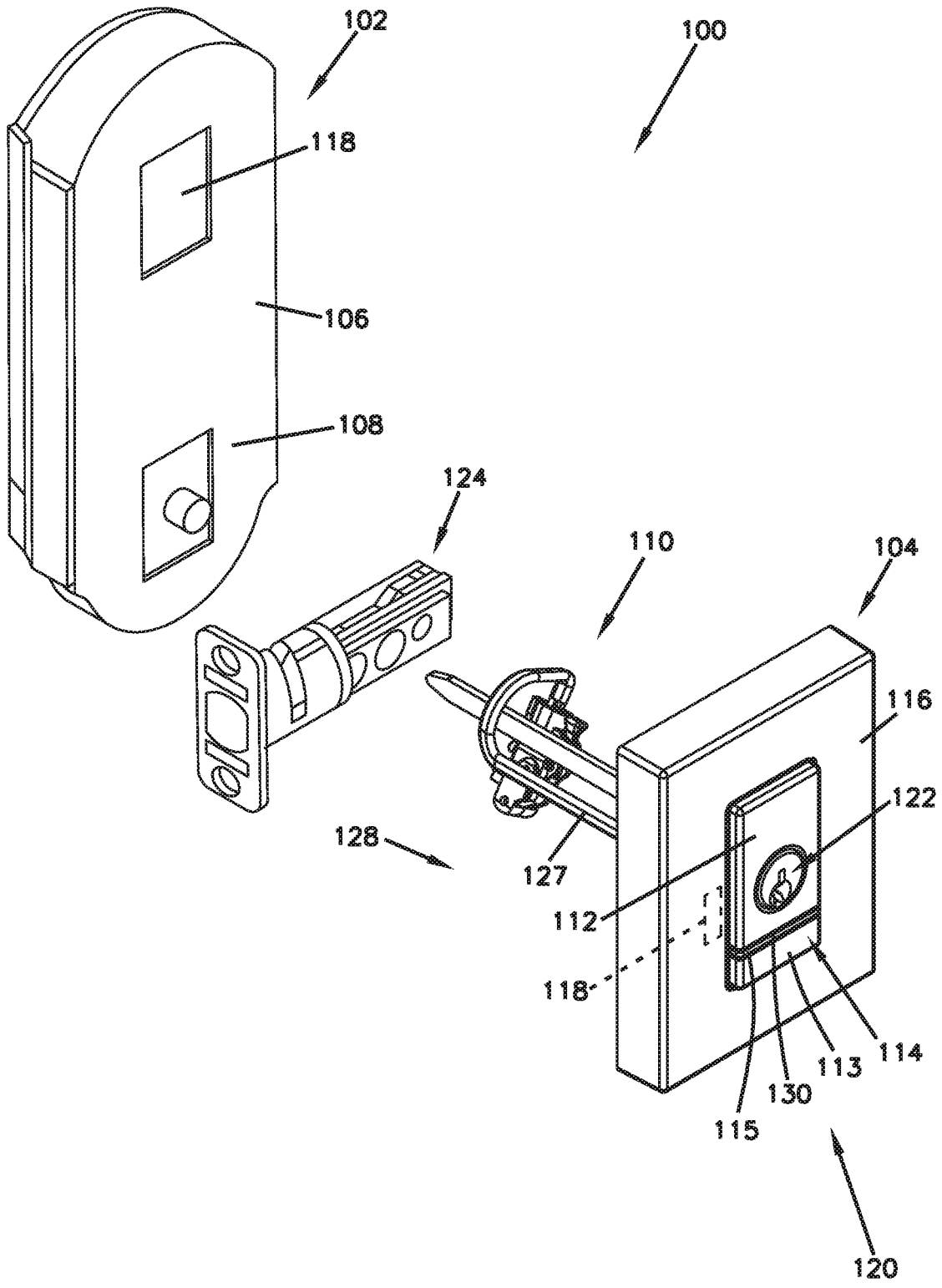
FIG. 1 is a schematic perspective view of an electronic lock, according to one example of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

This disclosure generally relates to an electromechanical lock with certain features. The term "electronic lock" is broadly intended to include any type of lockset that uses electrical power in some manner, including but not limited to, electronic deadbolts, electronic lever sets, etc. This disclosure encompasses the integration of one or more of features described herein into any type of electronic lock and is not intended to be limited to any particular type of electronic lock.

The electronic lock disclosed herein includes a plurality of advantages. The lock provides an isolated touch member that is used to selectably operate the electronic lock between a locked and unlocked state. By isolating the touch member, an exposed outer housing can be selectively interchanged (either at the time of manufacture or retrofit after the lock has been installed) with a variety of different outer housings to suit the preference of the user without effecting the operation of the electronic lock. Specifically, the touch member is electronically isolated from the outer housing via an insulating arrangement. In some examples, the insulating arrangement can include at least one seal. In other examples, the insulating arrangement includes a translucent portion that is configured to convey light to indicate the status of the lock. In some examples, the insulating arrangement weatherproofs the lock so that internal electronics (e.g., a circuit board and/or controller) are protected from the elements, such as water.

Figure 2:
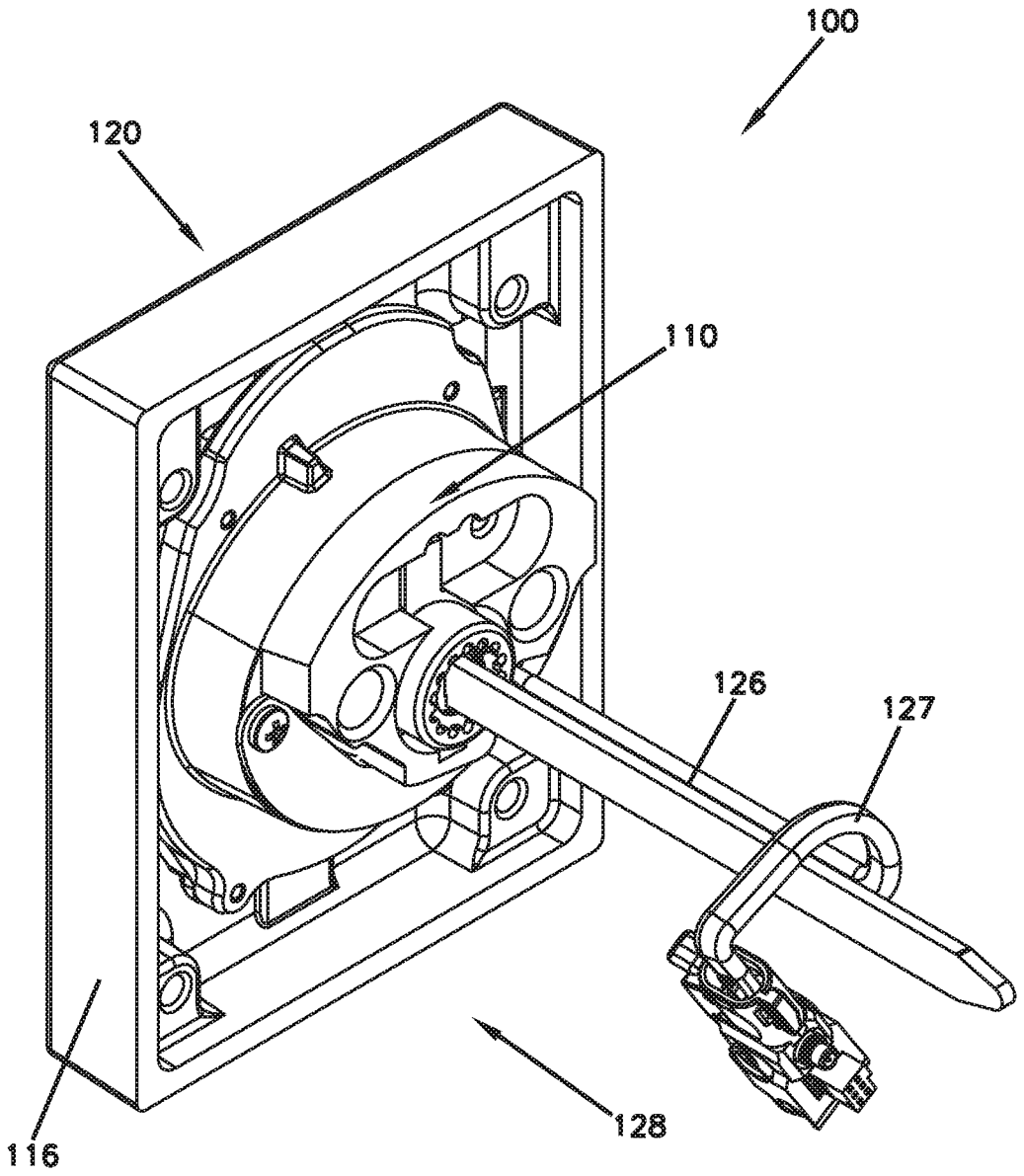
FIG. 2 is a rear perspective view of an exterior assembly of the electronic lock of FIG. 1.

FIG. 1 shows a partially exploded electronic lock 100, according to one example of the present disclosure. FIG. 2 shows a rear perspective view of a portion of the lock 100. The lock 100 includes an interior assembly 102 and an exterior assembly 104. The interior assembly 102 can include a housing 106 and a driver 108. The exterior assembly 104 can include a latch assembly 110, a conductive touch member 112, an insulating arrangement 114, and an outer housing 116. The lock 100 further includes a controller 118 that can be positioned within the interior or exterior assemblies 102, 104.

In some examples, the exterior assembly 104 is mounted on the outside of a door (not shown), while the interior assembly 102 is mounted inside a door. The latch assembly 110 is typically at least partially mounted in a bore formed in the door. The term "outside" is broadly used to mean an area outside a door and "inside" is also broadly used to denote an area inside a door. With an exterior entry door, for example, the exterior assembly 104 may be mounted outside a building, while the interior assembly 102 may be mounted inside a building. With an interior door, the exterior assembly may be mounted inside a building, but outside a room secured by the lock 100; the interior assembly 102 may be mounted inside the secured room. The lock 100 is applicable to both interior and exterior doors.

Figure 3:
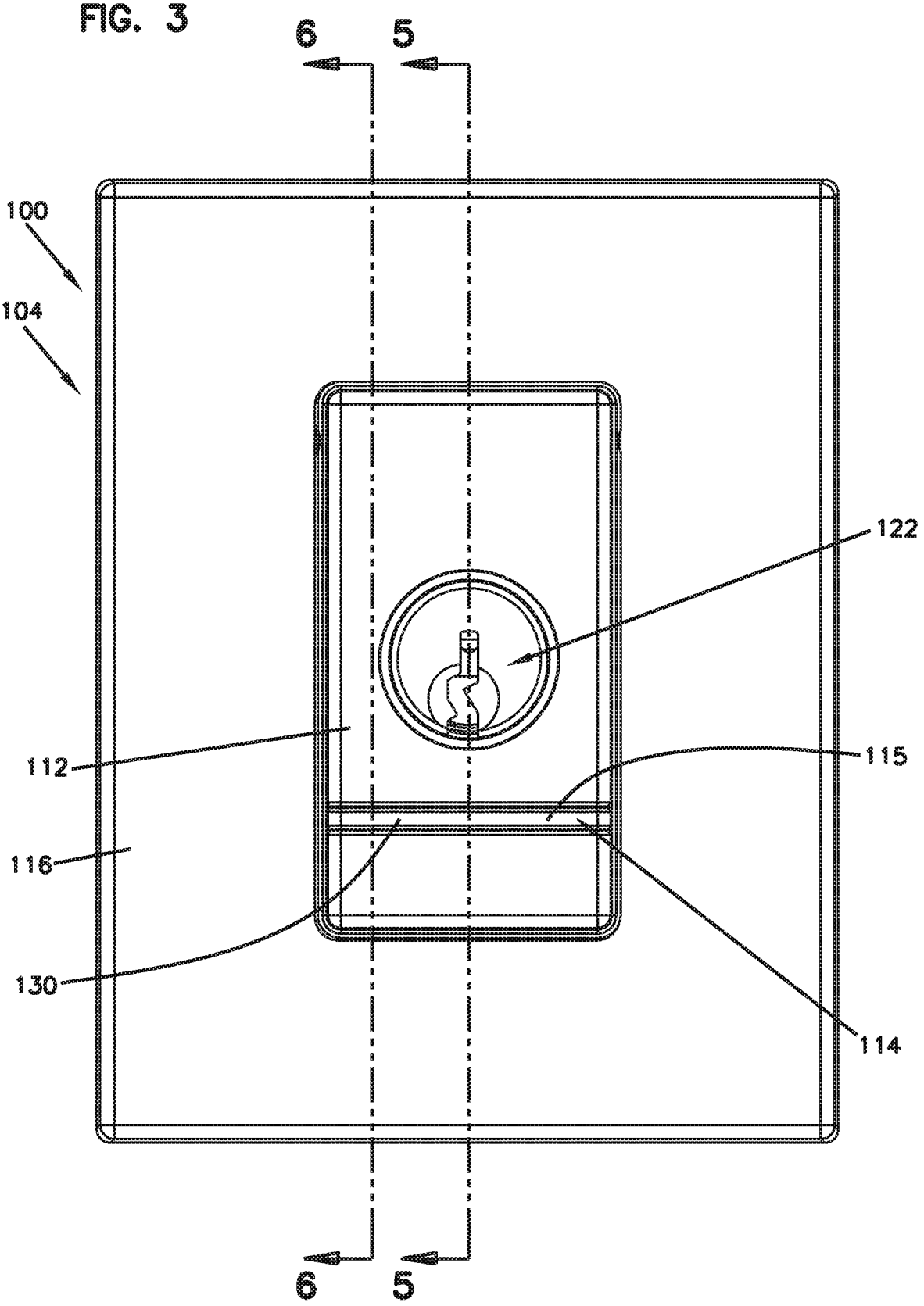
FIG. 3 is a front view of the exterior assembly of the electronic lock of FIG. 1.

When installed in a door (not shown), at least the touch member 112 and the outer housing 116 are exposed to the user at a front portion 120 of the lock 100 at the exterior of the door, as shown in FIG. 3. In some examples, a portion of the insulating arrangement 114 is also exposed to the user. To interact with the lock 100, the user can use a key (not shown) to operate the lock 100 via a mechanical locking assembly 122 and/or provide a touch input to the conductive touch member 112, that is in communication with the controller 118, to electronically operate the lock 100. If the user provides a touch input to the outer housing 116, the lock 100 will not electronically operate (even if the user possesses authenticated credentials).

In the depicted example, the latch assembly 110 includes a bolt 124 that may be actuated manually by the mechanical lock assembly 122, or electronically via the touch member 112 and controller 118 to extend/retract the bolt 124. The bolt 124 is configured to slide longitudinally and when the bolt 124 is retracted, the door is in an unlocked state. When the bolt 124 is extended, the bolt 124 protrudes from the door into a door jamb (not shown) to place the door in a locked state.

The latch assembly 110 also includes an extension 126 that extends from a rear portion 128 of the lock 100. The extension 126 is configured to interface with the bolt 124 and with the interior assembly 102. In some examples, the extension 126 may be driven to extend/retract the bolt 124 in several ways. For example, the mechanical lock assembly 122 could be actuated by a mechanical key to rotate the extension 126, which would allow the bolt 124 to be extended/retracted. The exterior assembly 104 could be used to electronically actuate the latch assembly 110 by providing a touch input to the touch member 112 (assuming the lock 100 received authenticated credentials prior to the user touching the touch member 112). In some examples, by providing a touch input to the touch member 112 to actuate the bolt 124, a message is sent from the exterior assembly 104 to the interior assembly 102 using a wiring harness 127 to actuate the driver 108 in the interior assembly 102 that drives the extension 126. Additionally, if the user is inside the door, a turn piece (not shown) could be manually rotated by the user to actuate the extension 126, thereby moving the bolt 124 between its extended and retracted positions.

As noted above, the touch member 112 is configured to enable the lock 100 to be touch activated. For example, the lock 100 may use capacitive sensing to determine whether the user wants to actuate the lock 100. In some examples, the touch member 112 can be the only surface on the exterior assembly 104 that is used for capacitive sensing to actuate the lock assembly 100. In other examples, other portions of the exterior assembly 104 could be used for capacitive sensing, including but not limited to, a keyway, handle, rose, or other exterior surface of the lock assembly 100 except for the outer housing 116. In the example shown, the exterior assembly 102 uses capacitive sensing to determine when a user touches the touch member 112. Accordingly, in the example shown, the user is able to touch anywhere on the touch member 112 to lock or unlock the lock 100, or otherwise activate various functions of the lock 100.

The touch member 112 can be formed in any size, shape, or from any conductive material. In some examples, the touch member 112 is formed at least partially from zinc. In other examples, the touch member 112 is formed at least partially from brass. In some examples, the lock 100 can include a badge 113 in electrical communication with the touch member 112 or electrically isolated from the touch member 112. In the depicted example, the badge 113 is electrically isolated from the touch member 112.

The insulating arrangement 114 is configured to electrically isolate the touch member 112 from the outer housing 116. In some examples, the insulating arrangement 114 includes a translucent portion 130 configured to convey a light from a light source (not shown) that is viewable by the user at the front portion 120 of the exterior assembly 104. In some examples, as will be further described below, the insulating arrangement 114 can also include at least one seal.

In some examples, the translucent portion 130 of the insulating arrangement 114 is a generally solid body formed from a non-conductive material. In some examples, the translucent portion 130 is formed from a co-molded plastic. In some examples, the translucent portion 130 is formed from Polycarbonate. In some examples, only a portion of the translucent portion 130 is exposed to, and viewable by, the user. In some examples, an exposed portion 115 of the translucent portion 130 at the front 120 of the exterior assembly 104 is a rectangular shape. In some examples, the exposed portion 115 of the translucent portion 130 includes a rectangular shape and a ring shape surrounding the mechanical locking assembly 122.

In some examples, light can be emitted from the translucent portion 130 at regions that could be independently controlled to visually communicate messages to the user, including but not limited to, an action currently being processed by the lock 100, information about the status of the lock 100, and/or requests for user input. By way of example, the translucent portion 130 could visually communicate the direction of bolt movement by illuminating regions in sequence to create a rotation or slide animation showing a direction of movement. The translucent portion 130 can communicate messages to the user by controlling various attributes of the regions, such as turning regions on/off, changing intensity of regions, changing colors illuminated by regions, or other manners of changing the illumination of the translucent portion 130.

The outer housing 116 is at least partially positioned around the insulating arrangement 114 and touch member 112. The outer housing 116 can be of a variety of sizes, shapes, and finishes. In some examples, the outer housing 116 is generally rectangular. In other examples, the outer housing 116 is generally circular. In some examples, the outer housing 116 is removable. For example, an outer housing 116 having a brass finish and a generally rectangular shape can be interchanged (either at the time of manufacture or after the lock 100 has been installed) with an outer housing 116 having a silver finish and a generally circular shape. Because the outer housing 116 is electrically isolated from the touch assembly, outer housings can be cost effectively interchanged either after install of the lock 100 or when the user is purchasing the lock 100. In some examples, this allows for the manufacture of a single exterior assembly 104, sans the outer housing 116, and the manufacture of infinite different outer housings 116 to allow the user to customize the physical look of the lock 100. This allows the user to match the sizes, shapes, and finishes of other hardware in their home or business while still providing a full featured electronic lock.

In some examples, the outer housing 116 can be connected to the rest of the exterior assembly 104 (e.g., the latch assembly 110) via fasteners 132. In other examples, the outer housing 116 can be connected to the rest of the exterior assembly 104 (e.g., the latch assembly 110) via securing tabs or other like tool-less securing solutions. In other examples, the outer housing 116 is connected directly to the door.

Figure 4:
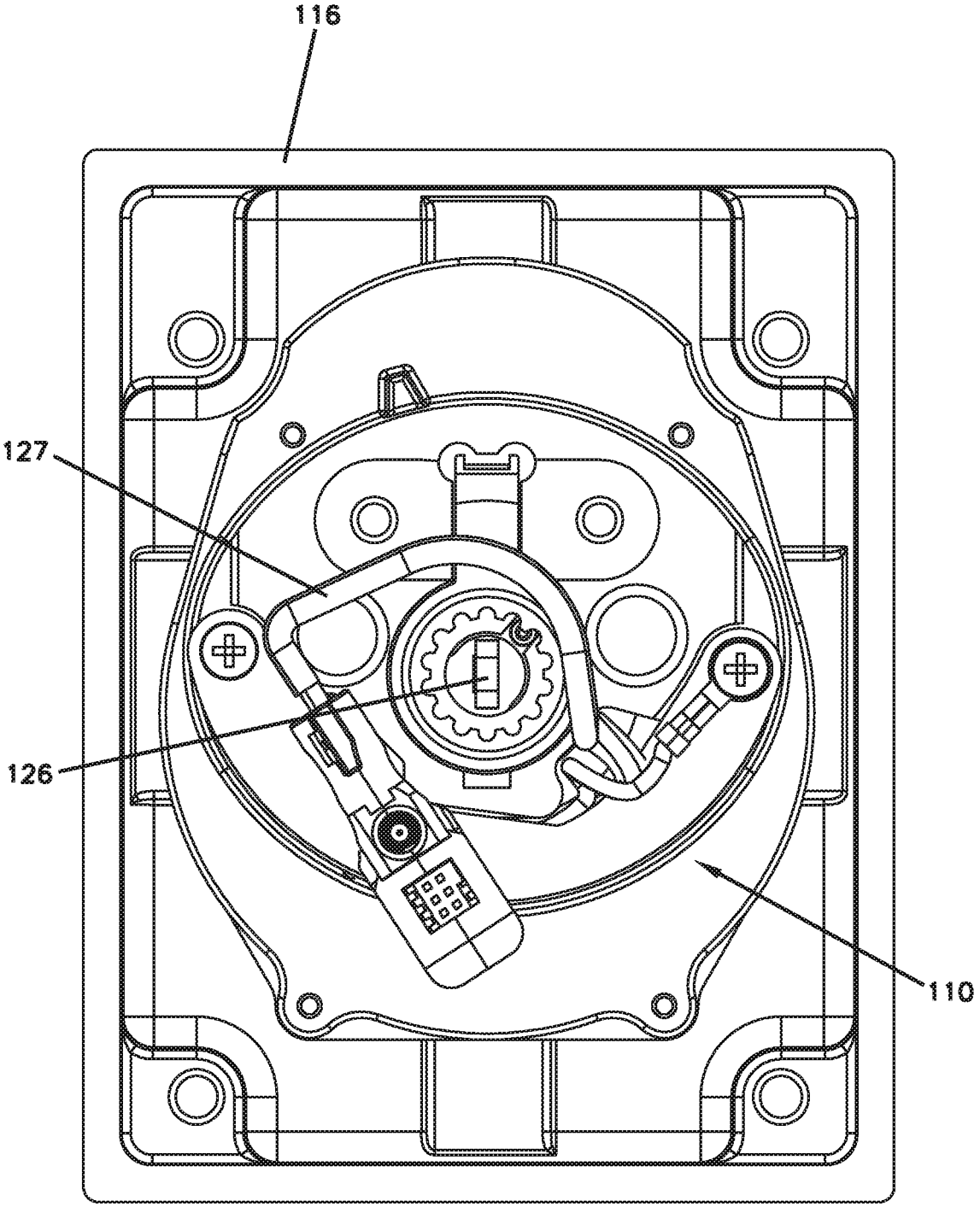
FIG. 4 is a rear view of the exterior assembly of the electronic lock of FIG. 1.

The controller 118 of the lock is configured to be electrically connected to the touch member 112 to selectively control the movement of the bolt 124. In some examples, the controller 118 is mounted within the exterior assembly 104 and/or in the interior assembly 102 and connected to the exterior assembly 104 via the wiring harness 127, which passes through a latch housing 134 of the latch assembly 110 at the rear 128 of the exterior assembly, as shown in FIG. 4.

Figure 5:
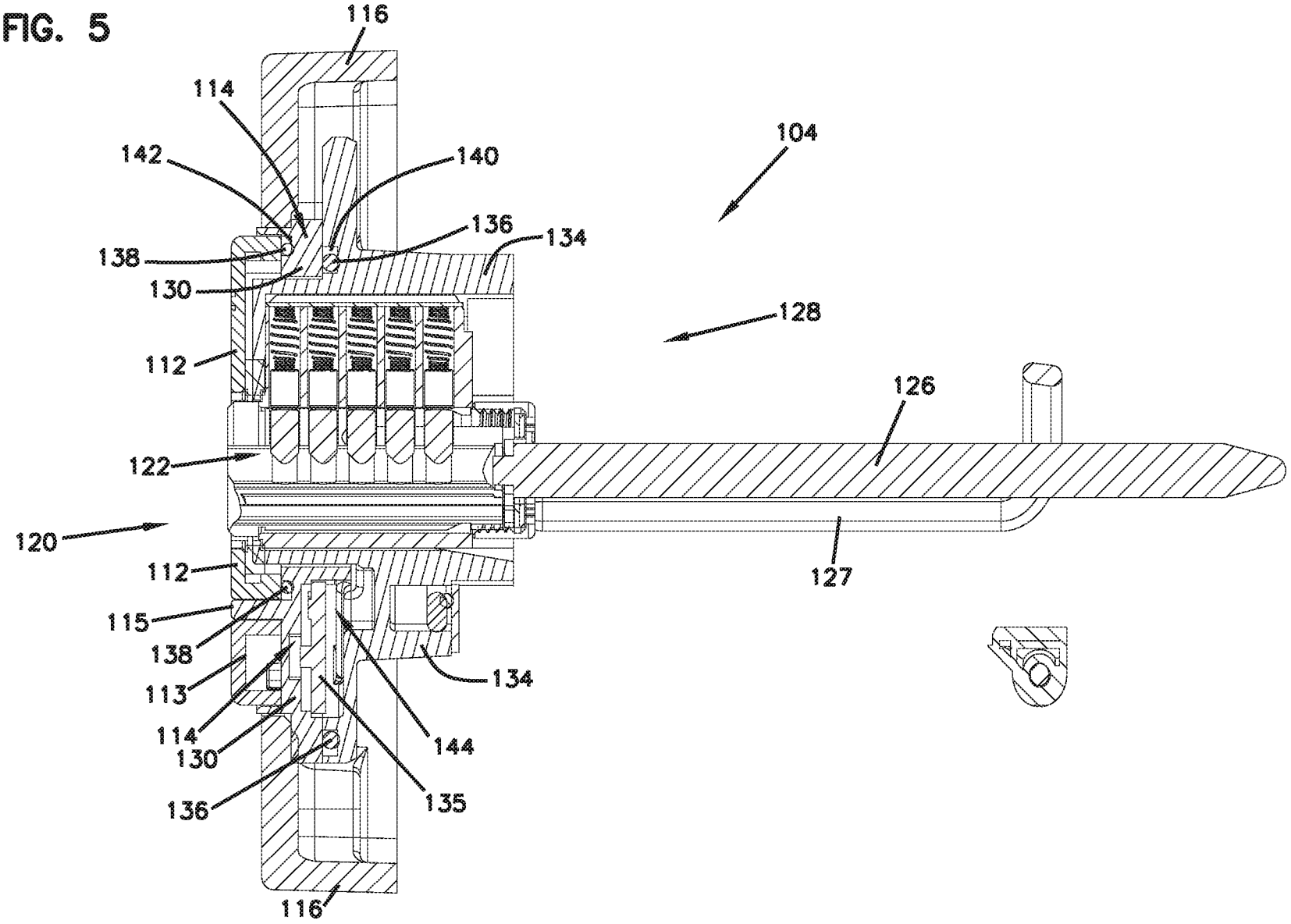
FIG. 5 is a cross-sectional view along line 5-5 in FIG. 3 of the exterior assembly of the electronic lock of FIG. 1.

FIG. 5 is a side cross-sectional view of a portion of the exterior assembly 104 along line 5-5 in FIG. 3. As shown, the touch member 112 does not make contact with the outer housing 116. Specifically, the touch member 112 is separated from the outer housing 116 via the insulating arrangement 114. Further shown is a printed circuit board (PCB) 135 positioned within the exterior assembly 104.

The latch assembly 110 is shown to include the mechanical lock assembly 122 and the latch housing 134. The latch housing 134 surrounds the mechanical lock assembly 122. The mechanical lock assembly 122 is shown to be connected to the extension 126.

In the depicted example, the insulating arrangement 114 includes the translucent portion 130, a first seal 136, and a second seal 138. The first seal 136 is positioned between the translucent portion 130 and the latch housing 134. In some examples, the first seal 136 is positioned in a recess 140 defined in the latch housing 134 of the latch assembly 110. The second seal 138 is positioned between the translucent portion 130 and the touch member 112. In some examples, the second seal 138 is positioned in a recess 142 defined by the translucent portion 130. In some examples, the seals 136, 138 are rubber O-rings. However, it is considered within the scope of the present disclosure that the seals 136, 138 can be any of a variety of different types of seals including, but not limited to, sealants, gaskets, or the like.

The PCB 135 is positioned in a cavity 144 formed between the latch housing 134 and the insulating arrangement 114, specifically the translucent portion 130. In some examples, the first and second seals 136, 138 weatherproof the cavity 144 to prevent ingress of moisture into the cavity 144.

The PCB 135 is in electrical communication with the touch member 112 and also in electrical communication with the wiring harness 127. In some examples, the wiring harness 127 connects the PCB with the interior assembly 102. In some examples, the PCB draws power via the wiring harness 127 from the interior assembly 102. In other examples, the PCB 135 can include an on-board power source, such as a battery (not shown).

The PCB 135 can host the touch electronics. In some examples, the PCB includes the controller 118 positioned thereon. The controller 118 can receive touch inputs via the touch member 112 and move the bolt 124 between the extended and retracted positions, respectively.

Figure 6:
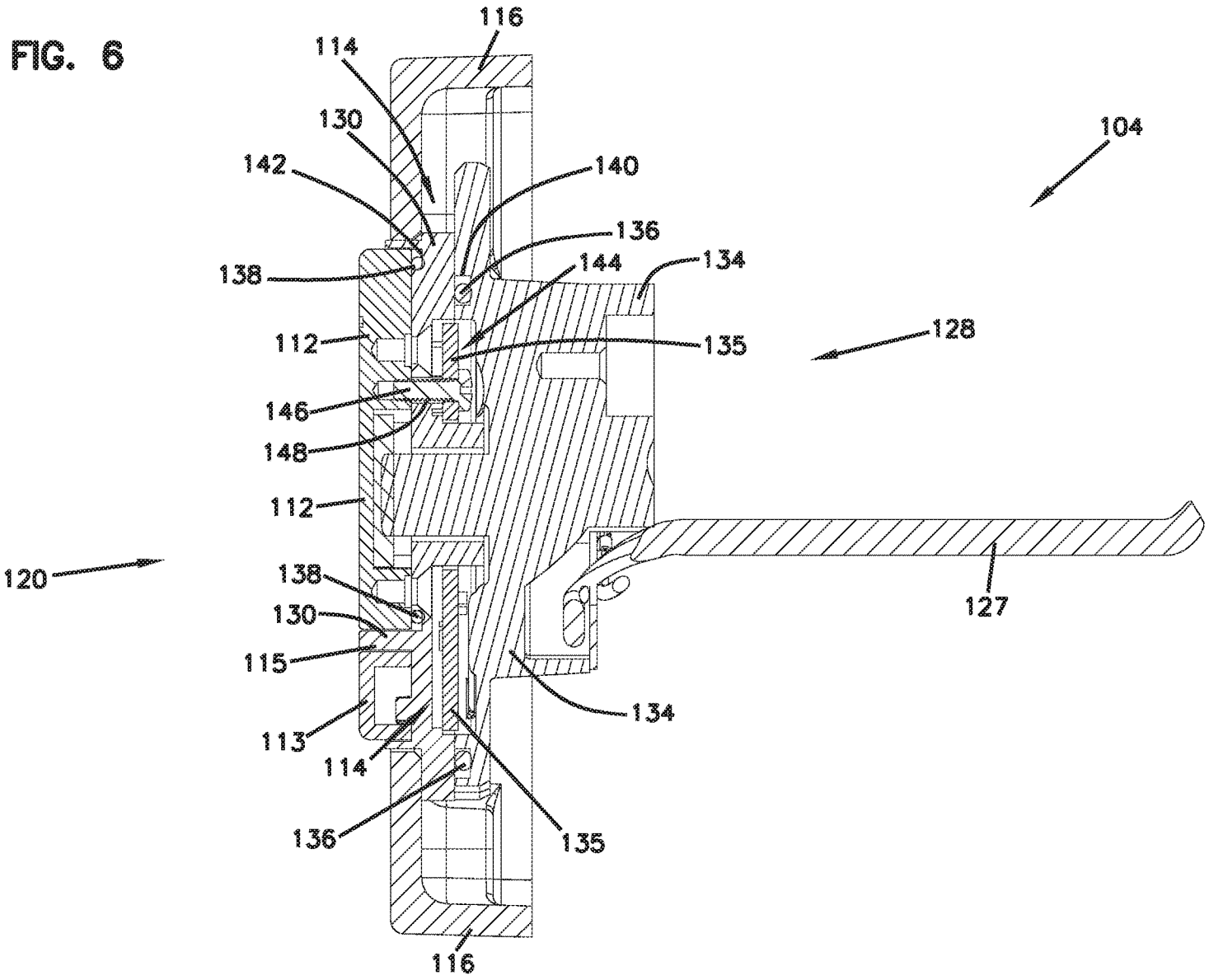
FIG. 6 is a cross-sectional view along line 6-6 in FIG. 3 of the exterior assembly of the electronic lock of FIG. 1.

FIG. 6 is a side cross-sectional view of a portion of the exterior assembly 104 along line 6-6 in FIG. 3. As shown, the PCB 135 is positioned within the cavity 144. Further shown is the electrical connection between the PCB 135 and the touch member 112 via a conductor 146.

In this example, the conductor 146 is a conductive fastener connecting the PCB 135 and the touch member 112. The conductor 146 passes through an aperture 148 defined in the insulating arrangement 114. The aperture 148 is positioned at a point on the translucent portion to align with the cavity 144. The first seal 136 surrounds the aperture 148, thereby forming a weatherproof seal, at the side of the aperture 148 that is nearest the cavity 144. The second seal 138 surrounds the aperture 148, thereby forming a weatherproof seal, at the side of the aperture nearest the touch member 112. Therefore, the first and second seals 136, 138 prevent weather (i.e., water) from gaining access to the cavity 144.

The conductor 146 can be any of a variety of conductors to facilitate electrical connection between the touch member 112 and the PCB 135. In the example shown, because the insulating arrangement 114, specifically the translucent portion 130, is formed at least partially of a non-conductive material, the touch member 112 and PCB 135 remain electrically isolated from the outer housing 116.

With the conductor 146, the PCB 135 can sense when a user touches anywhere on the touch member 112. Although a conductive fastener is shown as the conductor 146 for purposes of example, the conductor 146 could be a conductive washer/plate embedded within the translucent portion 130, conductive foam, conductive tape, conductive grease, or any other mechanical device electrically connecting the touch member 112 of the lock 100 to the PCB 135 that hosts the touch electronics. In some examples, the PCB 135 can also be in communication with an antenna embedded within the exterior assembly 104.

Figure 7:
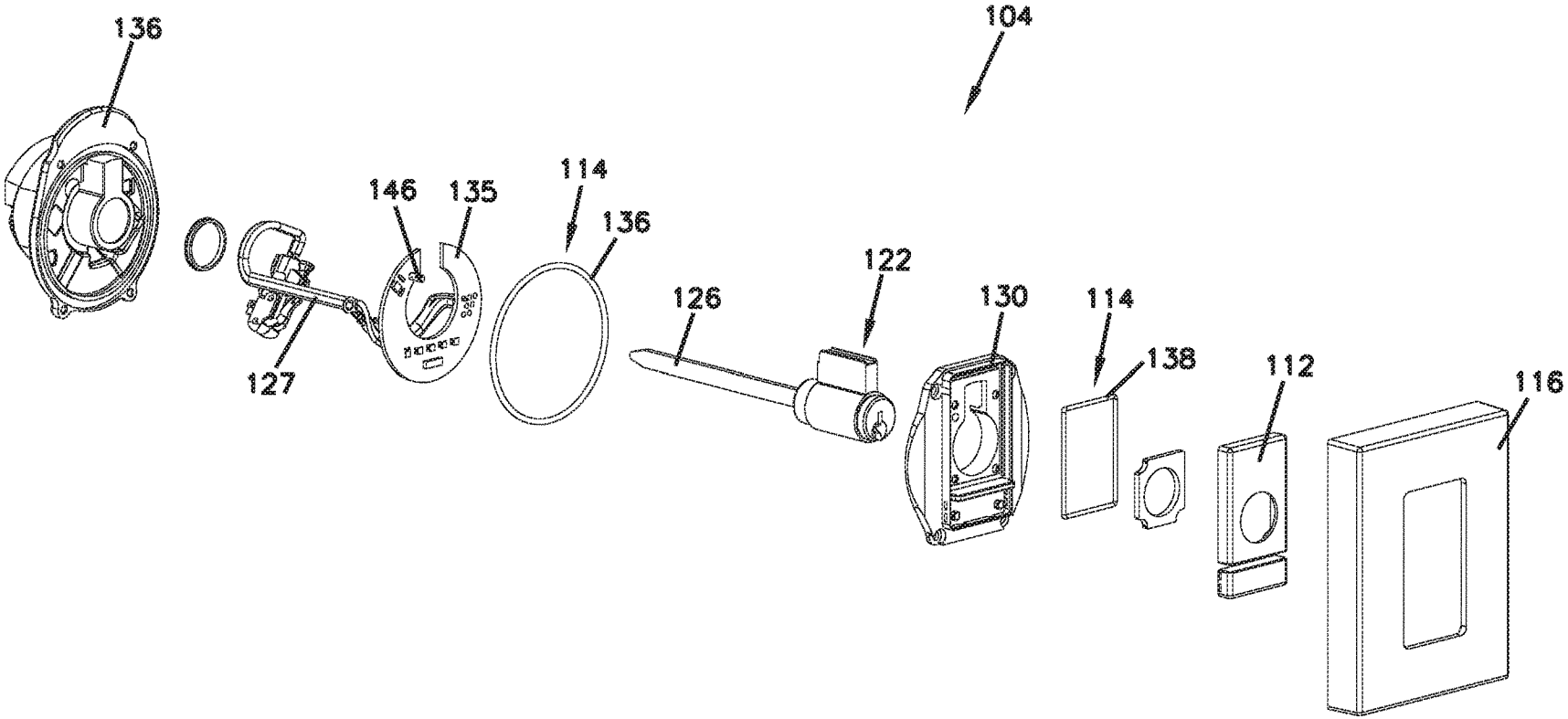
FIG. 7 is an exploded view of the exterior assembly of the electronic lock of FIG. 1.

FIG. 7 shows an exploded view of the exterior assembly 104. The exterior assembly 104 is just one example of the exterior assembly. For example, the touch member 112 can be generally circular and the insulating arrangement 114, outer housing 116, latch housing 134, and PCB 135 can be sized and shaped accordingly to accommodate the shape of the touch member 112.

FIGS. 8-14 show an electronic lock 200 according to one example of the present disclosure. The electric lock 200 is substantially similar to the electric lock 100, described above. The electric lock 200 can include an interior assembly and bolt, both substantially similar to the interior assembly 102, and bolt 124 described above. Because of this, only an exterior assembly 204 is shown and described. The exterior assembly 204 is configured to be paired with a bolt, like bolt 124, and an interior assembly, like interior assembly 102, to operate in a substantially similar manner as the electronic lock 100.

Figure 8:
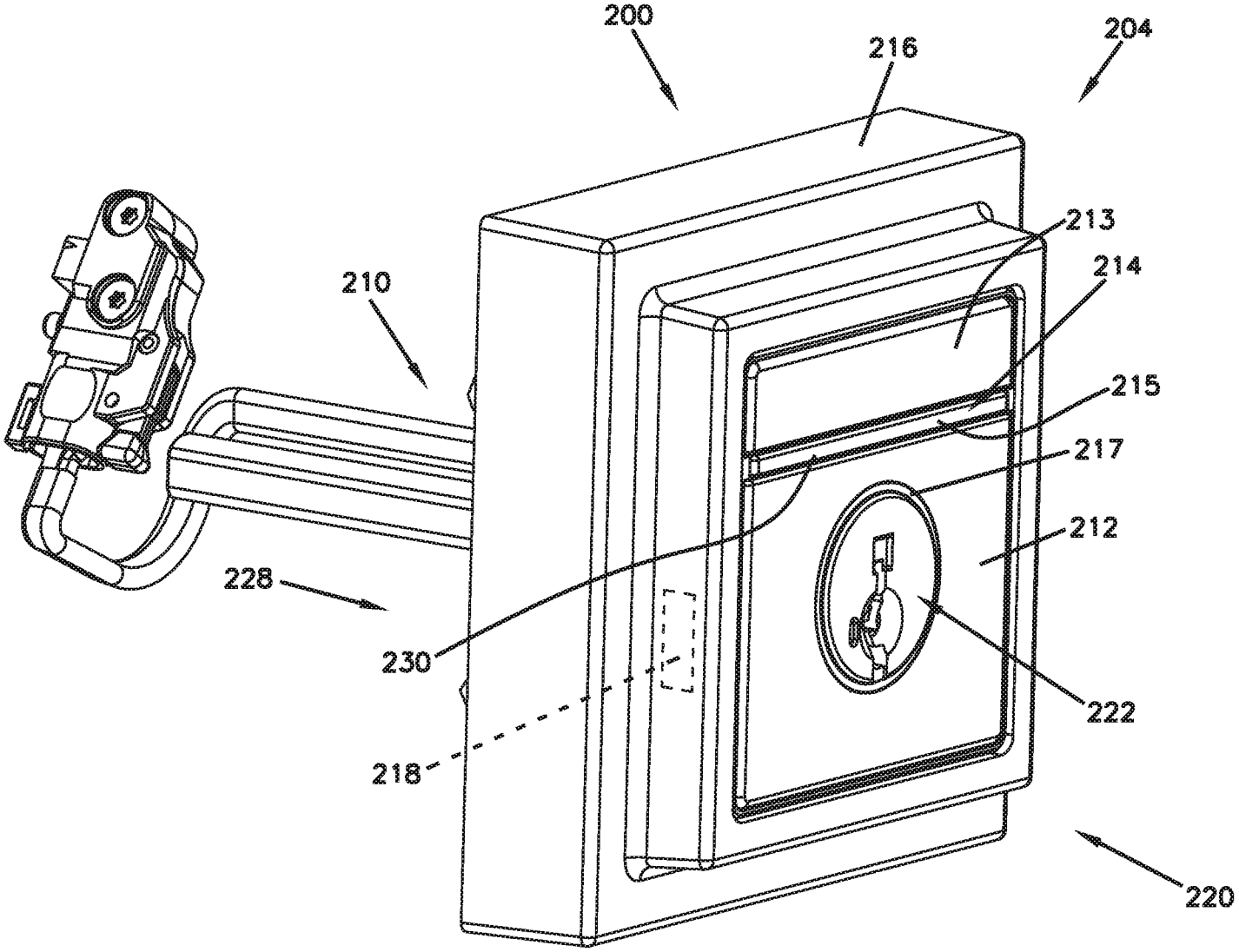
FIG. 8 is a schematic perspective view of an electronic lock, according to one example of the present disclosure.
Figure 9:
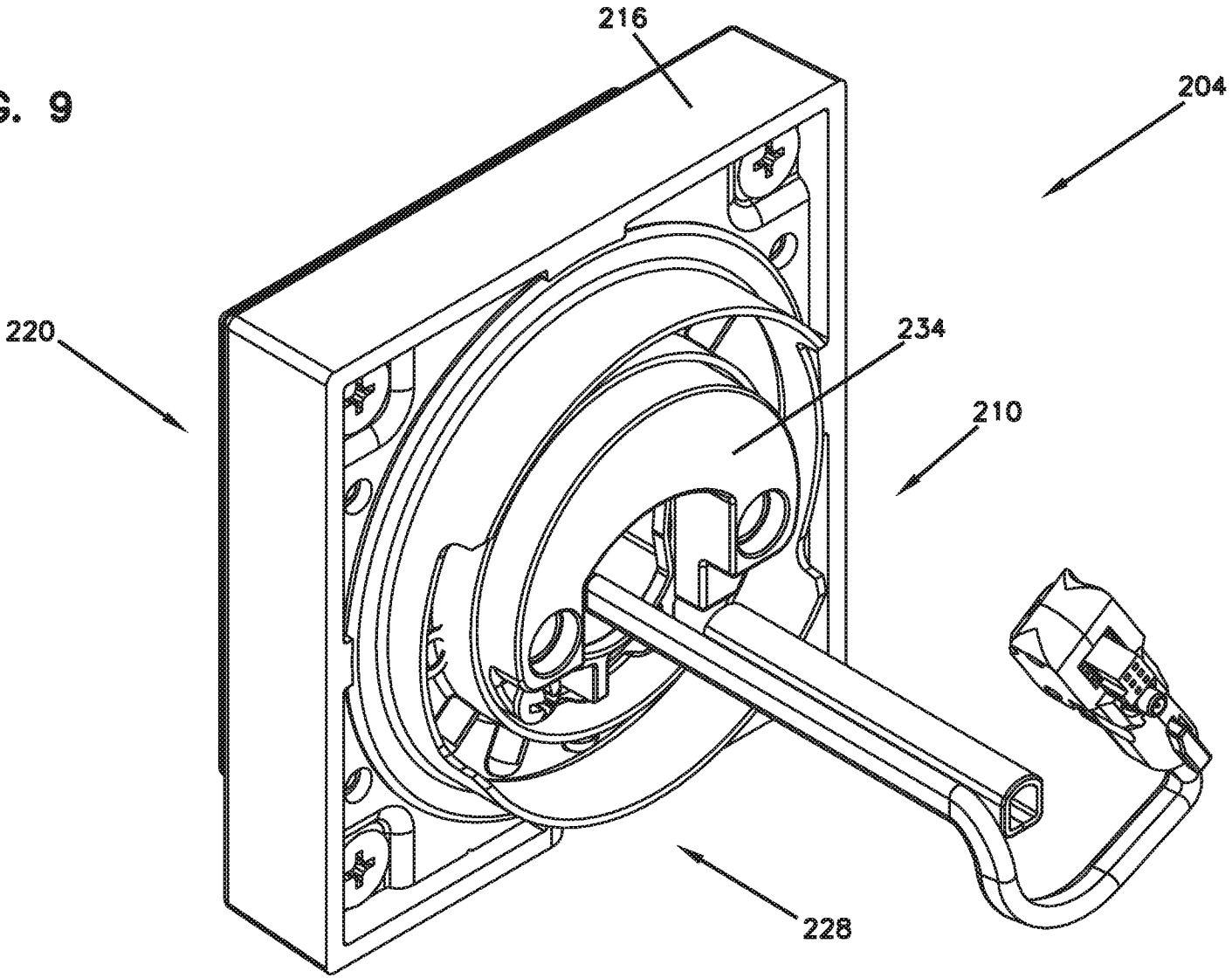
FIG. 9 is a rear perspective view of an exterior assembly of the electronic lock of FIG. 8.
Figure 10:
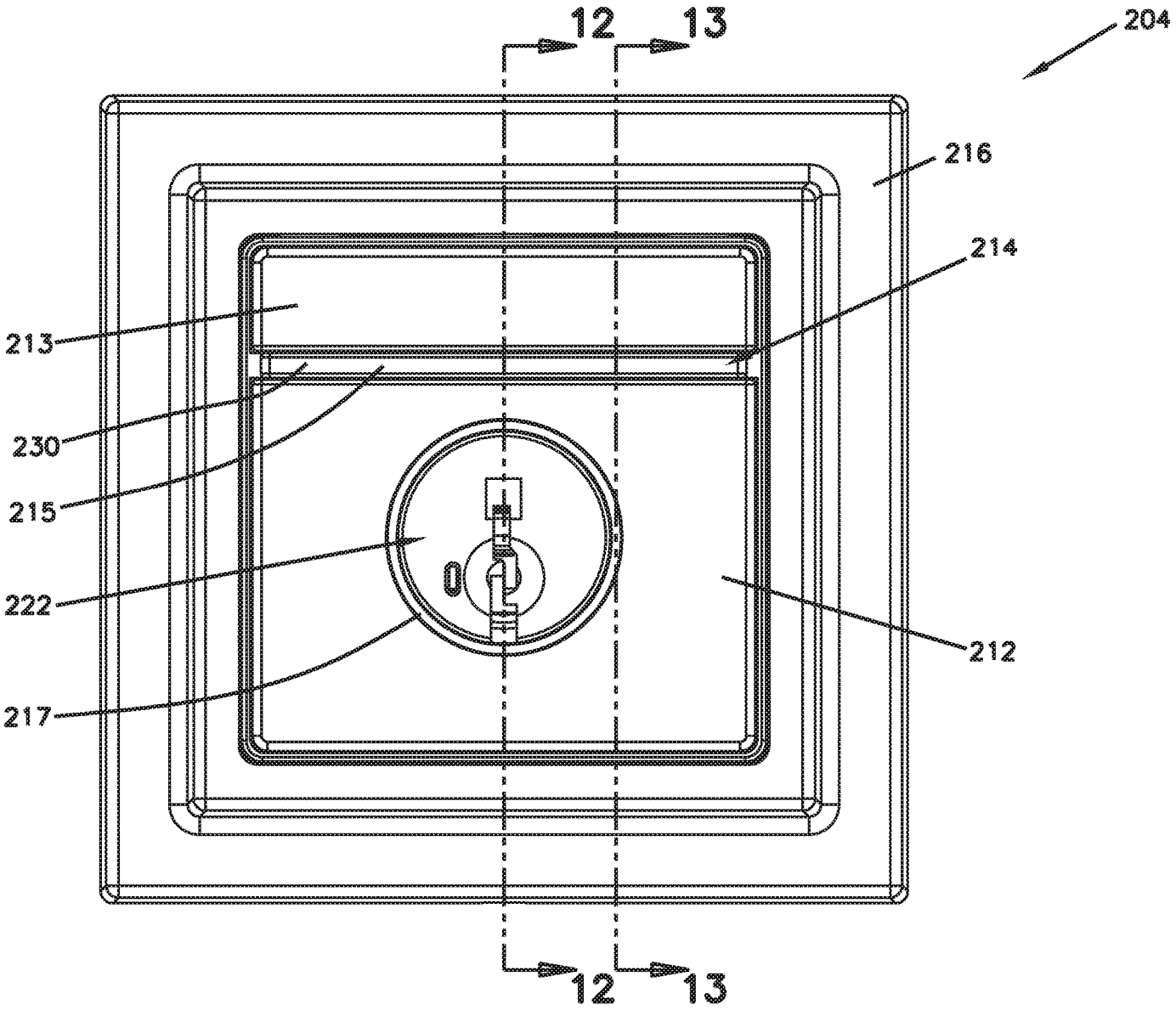
FIG. 10 is a front view of the exterior assembly of the electronic lock of FIG. 8.
Figure 11:
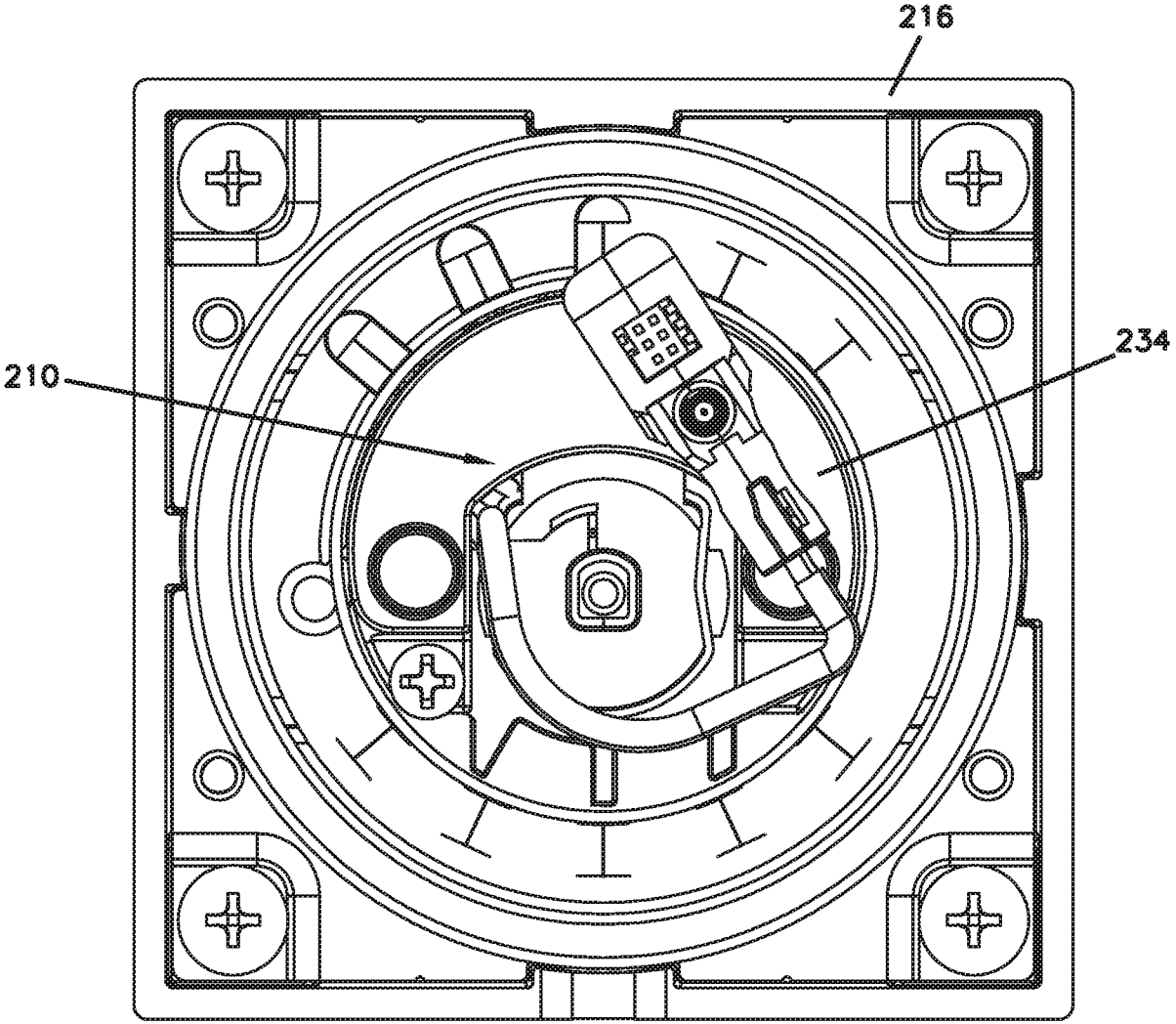
FIG. 11 is a rear view of the exterior assembly of the electronic lock of FIG. 8.
Figure 12:
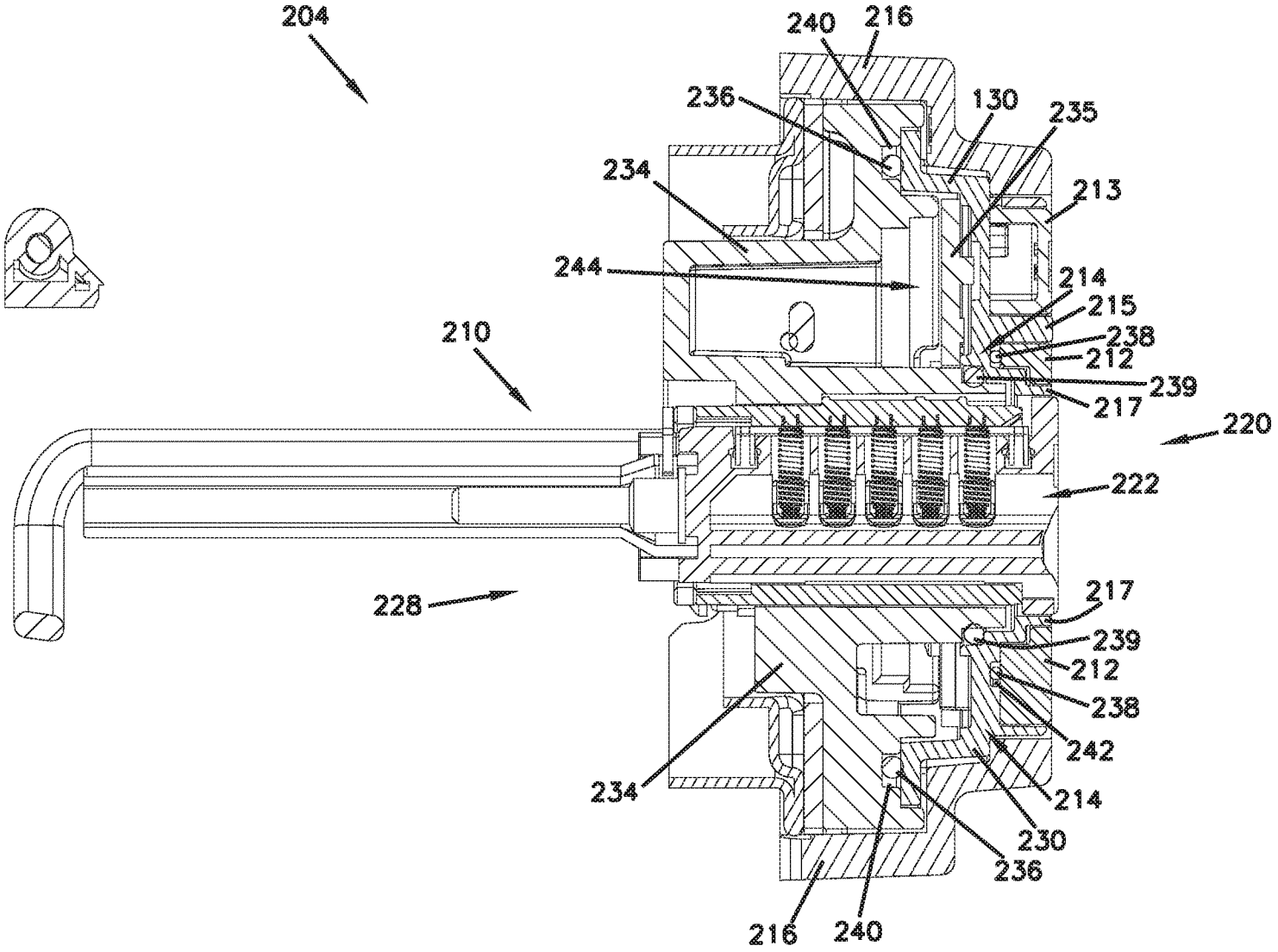
FIG. 12 is a cross-sectional view along line 12-12 in FIG. 10 of the exterior assembly of the electronic lock of FIG. 8.

FIG. 8 shows a front perspective view of the exterior assembly 204, and FIG. 9 shows a rear perspective view of the exterior assembly 204. FIG. 10 shows a front view of a front side 220 of the exterior assembly 204, and FIG. 11 shows a rear view of a rear side 228 of the exterior assembly 204.

The exterior assembly 204 of the electronic lock 200 includes a latch assembly 210, a conductive touch member 212, an insulating arrangement 214, and an outer housing 216. The outer housing 216 is electronically isolated from the touch member 212. The lock 200 further includes a controller 218. To interact with the lock 200, the user can use a key (not shown) to operate the lock 200 via a mechanical locking assembly 222 and/or provide a touch input to the conductive touch member 212, that is in communication with the controller 218, to electronically operate the lock 200. If the user provides a touch input to the outer housing 216, the lock 200 will not electronically operate (even if the user possesses authenticated credentials).

The outer housing 216 is at least partially positioned around the insulating arrangement 214 and touch member 212. The outer housing 216 can be of a variety of sizes, shapes, and finishes. In some examples, the outer housing 216 is generally rectangular. In other examples, the outer housing 216 is generally circular. In some examples, the outer housing 216 is removable. For example, an outer housing 216 having a first finish and a first shape can be interchanged (either at the time of manufacture or after the lock 200 has been installed) with an outer housing 216 having a second finish and/or a second shape.

Like the insulating arrangement 114 described above, the insulating arrangement 214 includes a translucent portion 230 and a plurality of seals. Specifically, the insulating arrangement 214 includes a first seal 236 positioned between the translucent portion 230 and a latch housing 234 of the latch assembly 210. In some examples, the first seal 236 is positioned in a recess 240 defined in the latch housing 234 of the latch assembly 210. A second seal 238 is positioned between the translucent portion 230 and the touch member 212. In some examples, the second seal 238 is positioned in a recess 242 defined by the translucent portion 230. A third seal 239 is provided between the latch housing 234 and the translucent portion 230. In some examples, the seals 236, 238, 239 are rubber O-rings and gaskets. However, it is considered within the scope of the present disclosure that the seals 236, 238, 239 can be any of a variety of different types of seals including, but not limited to, sealants, gaskets, or the like.

As shown, the translucent portion 230 is exposed to the front side 220 adjacent to the touch member 212 at a variety of locations. Specifically, the translucent portion 230 includes a first exposed portion 215 and a second exposed portion 217 (also shown in FIGS. 8 and 10). In the depicted example, the first exposed portion 215 forms a rectangular shape at the front side 220 of the lock 200. In the depicted example, the second exposed portion 217 forms a ring around the mechanical lock assembly 222. The first and/or the second exposed portions 215, 217 are configured to expose a light to the user to inform the user of the status of the lock, substantially similar to the translucent portion 130 described above. By way of example, the translucent portion 230, specifically the exposed portion 217, could visually communicate the direction of bolt movement by illuminating regions in sequence to create a rotation animation showing a direction of movement.

Because the translucent portion 230 includes a second exposed portion 217, the third seal 239 is configured to prevent water from gaining access to a cavity 244 that contains a PCB 235 (substantially similar to the cavity 144 and PCB 135 described above). The first and second seals 236, 238 are also configured to prevent water access to the PCB.

Figure 13:
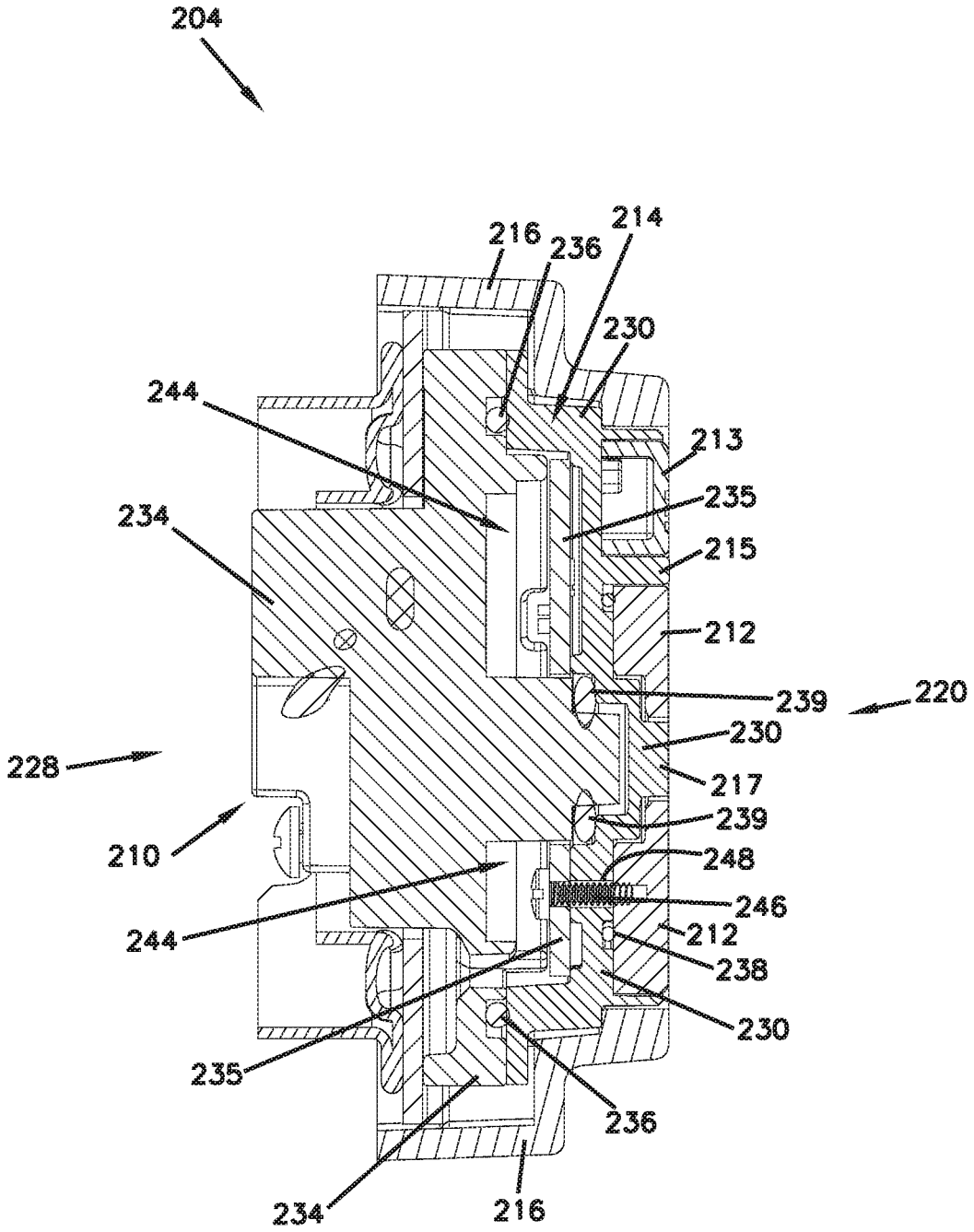
FIG. 13 is a cross-sectional view along line 13-13 in FIG. 10 of the exterior assembly of the electronic lock of FIG. 8.

FIG. 13 shows a cross-sectional side view of the lock 200 along the line 13-13 in FIG. 10. As shown, the PCB 235 is positioned within the cavity 244 and electrical communication is shown between the PCB 235 and the touch member 212 via a conductor 246. Like the conductor 146, described above, the conductor 246 passes through an aperture 248 in the translucent portion 230, thereby electrically connecting the touch member 212 and the PCB 235. The aperture 248 is sealed via the first, second, and third seals 236, 238, 239.

The conductor 246 can be any of a variety of conductors to facilitate an electrical connection between the touch member 212 and the PCB 235. With the conductor 246, the PCB 235 can sense when a user touches anywhere on the touch member 212. The conductor 246 could be a conductive fastener, washer/plate embedded within the translucent portion 130, conductive foam, conductive tape, conductive grease, or any other mechanical device electrically connecting the touch member 212 of the lock 200 to the PCB 235 that hosts the touch electronics.

Figure 14:
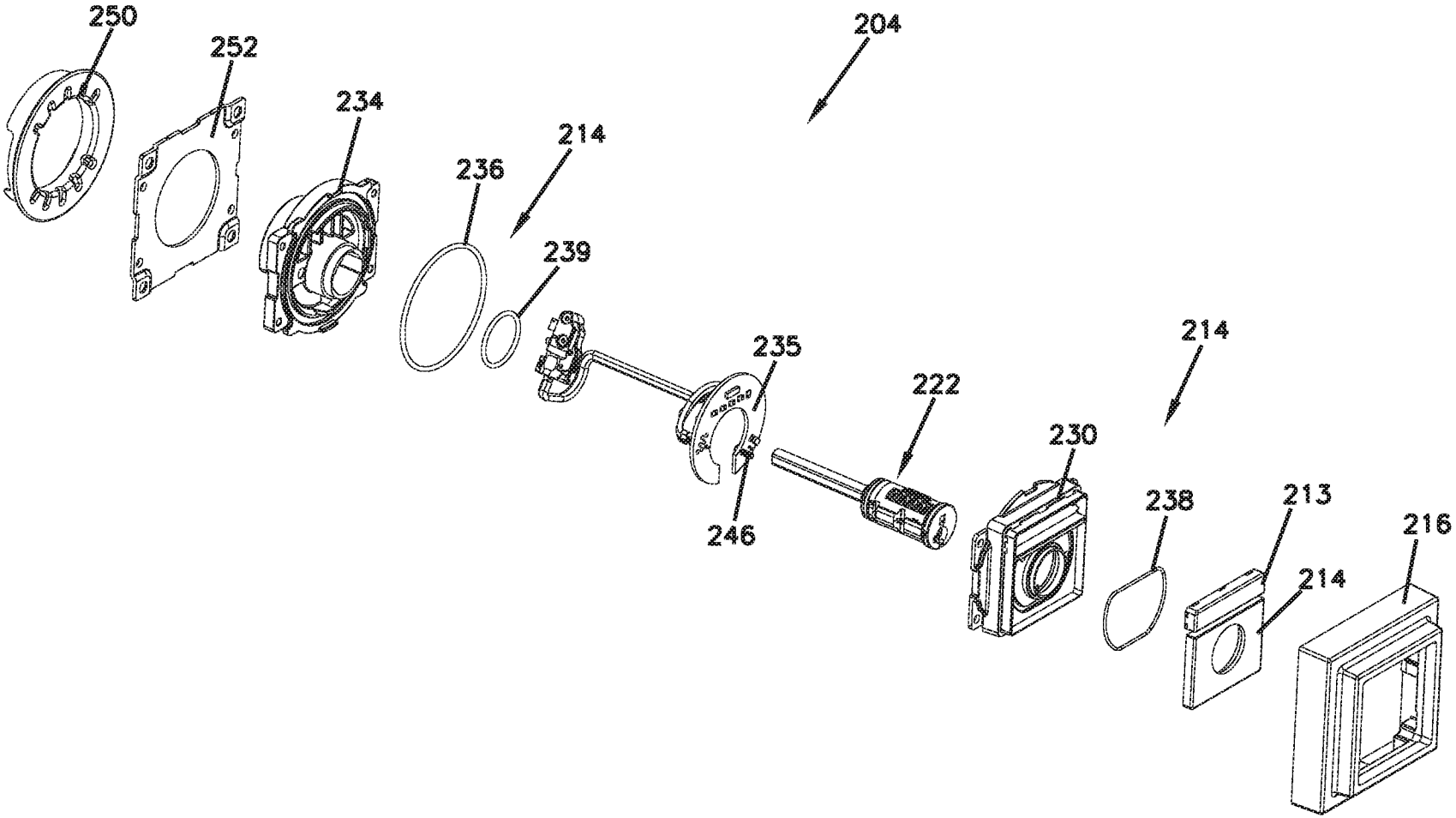
FIG. 14 is an exploded view of the exterior assembly of the electronic lock of FIG. 8.

FIG. 14 shows an exploded view of the exterior assembly 204. A pair of mounting brackets 250, 252 are shown. The mounting bracket 250 is configured to aid in connecting the exterior assembly 204 within a door. The mounting bracket 252 can aid in mounting the outer housing 216 to the latch assembly 210, specifically to the latch housing 234.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

We claim:

1. An electronic lock comprising:

a latch assembly having a latch housing and a bolt movable between an extended position and a retracted position;

a controller connected to a circuit board, the circuit board being positioned within an interior cavity, the cavity being at least partially defined by the latch housing, the controller being configured to electronically control movement of the bolt between the extended position and the retracted position;

a conductive touch member having an exposed surface and an interior surface, the conductive touch member being in electrical communication with the controller;

an insulating arrangement positioned between the conductive touch member and the circuit board;

a conductor connecting the circuit board and the conductive touch member, wherein the conductor passes through an aperture in the insulating arrangement and contacts the circuit board and the interior surface of the conductive touch member; and a housing at least partially surrounding the conductive touch member, the housing being electrically isolated from the conductive touch member by at least a portion of the insulating arrangement;

wherein the insulating arrangement separates the circuit board from the conductive touch member with the conductive touch member exterior to the insulating arrangement and the circuit board interior of the insulating arrangement; and wherein the housing is interchangeable with at least one housing having a different size or shape, the at least one housing being electrically isolated from the conductive touch member when installed.

2. The electronic lock of claim 1, further comprising a plurality of seals for weather protection of the circuit board.

3. The electronic lock of claim 1, wherein the housing is isolated from the conductive touch member by at least one seal of the insulating arrangement.

4. The electronic lock of claim 1, wherein the insulating arrangement includes a non-conductive translucent portion.

5. The electronic lock of claim 4, wherein the non-conductive translucent portion is co-molded Polycarbonate.

6. The electronic lock of claim 1, wherein the interior cavity is defined by the insulating arrangement and the latch housing, and wherein the interior cavity is sealed.

7. The electronic lock of claim 6, wherein the insulating arrangement includes a translucent portion and a first and a second seal, wherein the first seal is positioned between the conductive touch member and the translucent portion, and wherein the second seal is positioned between the translucent portion and the latch housing.

8. The electronic lock of claim 7, wherein the insulating arrangement further comprises a third seal positioned between the translucent portion and the latch housing.

9. The electronic lock of claim 1, wherein the controller is configured to electronically control movement of the bolt between the extended position and the retracted position based on a touch input received at the conductive touch member.

10. The electronic lock of claim 1, wherein the housing that is electrically isolated from the conductive touch member is circular.

11. The electronic lock of claim 1, wherein the housing that is electrically isolated from the conductive touch member is rectangular.

12. The electronic lock of claim 1, wherein the conductor is a threaded mechanical fastener.

13. The electronic lock of claim 1, wherein the conductor further comprises a conductive washer or a conductive plate.

14. An electronic lock comprising:

a latch assembly having a latch housing and a bolt movable between an extended position and a retracted position;

a controller connected to a circuit board, the circuit board being positioned within an interior cavity, the cavity being at least partially defined by the latch housing, the controller being configured to electronically control movement of the bolt between the extended position and the retracted position;

a conductive touch member having an exposed surface and an interior surface, the conductive touch member being in electrical communication with the controller;

an insulating arrangement positioned between the conductive touch member and the circuit board, the insulating arrangement including a translucent portion configured to transmit light and at least one seal, the translucent portion at least partially defining the interior cavity, wherein the translucent portion is at least partially exposed adjacent the conductive touch member, wherein the at least one seal is positioned between at least one of the translucent portion and the latch housing and the translucent portion and the touch member to seal the interior cavity, wherein the insulating arrangement separates the conductive touch member from the circuit board;

a conductor connecting the circuit board and the conductive touch member, wherein the conductor passes through an aperture in the insulating arrangement and contacts the circuit board and the interior surface of the touch member to provide electrical connection between the circuit board and the conductive touch member; and a housing at least partially surrounding the conductive touch member, the housing being electrically isolated from the conductive touch member by at least a portion of the insulating arrangement;

wherein the insulating arrangement separates the circuit board from the conductive touch member with the conductive touch member exterior to the insulating arrangement and the circuit board interior of the insulating arrangement; and wherein the housing is interchangeable with at least one housing having a different size or shape, the at least one housing being electrically isolated from the conductive touch member when installed.

15. The electronic lock of claim 14, wherein the translucent portion is formed of a non-conductive co-molded Polycarbonate.

16. An electronic lock comprising:

a latch assembly having a latch housing and a bolt movable between an extended position and a retracted position;

a controller mounted to a circuit board, the circuit board being positioned within an interior cavity, the cavity being at least partially defined by the latch housing, the controller being configured to electronically control movement of the bolt between the extended position and the retracted position;

a conductive touch member having an exposed surface and an interior surface, the conductive touch member being in electrical communication with the controller via a conductor that connects to the circuit board and the interior surface of the conductive touch member;

an insulating arrangement positioned between the conductive touch member and the circuit board, the insulating arrangement including a body at least partially defining the interior cavity, wherein the body defines an aperture configured to receive the conductor, wherein the conductor passes through the aperture in the insulating arrangement, and wherein a first seal of the insulating arrangement surrounds the aperture; and a housing at least partially surrounding the conductive touch member, the housing being electrically isolated from the conductive touch member by at least a portion of the insulating arrangement;

wherein the insulating arrangement separates the circuit board from the conductive touch member with the conductive touch member exterior to the insulating arrangement and the circuit board interior of the insulating arrangement; and wherein the housing is interchangeable with at least one housing having a different size or shape, the at least one housing being electrically isolated from the conductive touch member when installed.

17. The electronic lock of claim 16, wherein the first seal surrounds the aperture at a first side nearest the conductive touch member.

18. The electronic lock of claim 16, further comprising a second seal surrounding the aperture at a second side nearest the latch housing.

19. The electronic lock of claim 16, wherein the body is translucent and partially exposed adjacent to the conductive touch member.

* * * * *